US005599140A

United States Patent [19]

Wright

[11] Patent Number: 5,599,140

[45] Date of Patent: Feb. 4, 1997

[54] MINE ROOF SUPPORT SYSTEM INCLUDING AN EXPANSION ANCHOR WITH MEANS ASSISTING RESIN COMPONENT MIXING AND METHOD OF INSTALLATION THEREOF

[75] Inventor: Raymond L. Wright, Syracuse, N.Y.

[73] Assignee: The Eastern Company, Naugatuck, Conn.

[21] Appl. No.: 527,779

[22] Filed: Sep. 13, 1995

[51] Int. Cl.[6] ..... E21D 20/00; E21D 20/02; E21D 21/00

[52] U.S. Cl. ..... 405/259.6; 405/259.3; 405/259.4

[58] Field of Search ..... 405/259.1, 259.3, 405/259.4, 259.5, 259.6

[56] References Cited

U.S. PATENT DOCUMENTS

| | | | |
|---|---|---|---|
| 4,516,886 | 5/1985 | Wright | 405/259.6 |
| 4,626,139 | 12/1986 | Blackwell | 405/259.1 |
| 4,861,198 | 8/1989 | Stankus | 405/259.6 |
| 5,018,908 | 5/1991 | Laphon | 405/259.1 X |
| 5,076,733 | 12/1991 | Frease | 405/259.1 |
| 5,112,160 | 5/1992 | Jensen et al. | 405/259.5 |
| 5,219,248 | 6/1993 | Wright | 405/259.4 |
| 5,222,835 | 6/1993 | Wright | 405/259.6 |
| 5,275,512 | 1/1994 | Wright | 405/259.1 |
| 5,344,257 | 9/1994 | Wright et al. | 405/259.1 X |

*Primary Examiner*—Stephen J. Novosad
*Attorney, Agent, or Firm*—Charles S. McGuire

[57] ABSTRACT

A reinforcing and support system and method of installation thereof including both a mechanical expansion anchor on the distal end of an elongated bolt and a resin grouting mix installed in a blind drill hole in a mine roof, or the like. A pair of elongated leg members, fixed with respect to the shell, extend into the annular space surrounding the bolt below the shell for a distance about as great as the axial length of the shell. Upon advance of the bolt, carrying the expansion anchor and leg members, into the drill hole to break a cartridge containing the initially flowable components of the grouting material, the bolt is rotated to effect expansion of the anchor and tensioning of the bolt. Mixing of the components in the annular space surrounding the bolt below the anchor as the bolt is rotated is enhanced by hydraulic turbulence produced by flow of the components about the leg members. A support nut may be installed on the bolt below the anchor, and the leg members may be fixedly attached to one another near their terminal ends.

30 Claims, 6 Drawing Sheets

MINE ROOF SUPPORT SYSTEM INCLUDING AN EXPANSION ANCHOR WITH MEANS ASSISTING RESIN COMPONENT MIXING AND METHOD OF INSTALLATION THEREOF

BACKGROUND OF THE INVENTION

The present invention is directed to the field of mine roof expansion anchors which are installed together with a two-part resin grouting mix to provide a combined mechanical-chemical anchor for an elongated roof bolt. More specifically, the invention concerns unique structure associated with the mechanical anchor to assist in mixing the initially flowable components of the resin mix, and to methods of installation of mine roof support systems including such anchors.

Mechanical expansion anchors have for many years provided a popular means of anchoring elongated bolts in drill holes in a rock structure. The bolts carry a bearing plate which is urged into contact with the surface of the rock structure as the bolt is tensioned to several thousand pounds, thereby supporting and reinforcing the rock structure adjacent the mine tunnel or passageway.

Chemical anchors, i.e., a plurality of initially flowable materials which harden after combination in the drill hole, have also been widely used to anchor roof bolts in drill holes. In fact, it has become common practice to use both a mechanical and a chemical anchor to firmly secure the distal end of a mine roof bolt in a drill hole. The resin mix components are isolated from one another in a two-compartment, elongated cartridge which is inserted into the drill hole in advance of the distal, threaded end of the bolt which carries the expansion anchor. The cartridge is fractured against the blind end of the drill hole as the bolt is fully inserted, allowing the grouting components to flow around the expansion anchor and the upper end of the bolt.

Earlier forms of chemical anchors required more thorough mixing of the components upon release from the cartridge and longer hardening times than currently available materials. Accordingly, the prior art includes a number of structural elements and installation methods devised to ensure proper mixing of the grouting components. Although the hydraulic action of the components produced by forceful fracture of the cartridge and the few seconds of bolt rotation required to set the mechanical anchor provide essentially all the mixing necessary for modern day grouting materials, it is still desirable to enhance the mixing to some extent, particularly in the area below the anchor, if this can be accomplished economically.

It is a principal object of the present invention to provide a novel and improved mine roof expansion anchor having means for enhancing the mixing of grouting mix components installed concurrently with the expansion anchor without significantly increasing the cost or installation time of the anchor.

Another object is to provide a combination mechanical-chemical anchor for a mine roof bolt wherein the mechanical portion includes novel and improved means for enhancing the mixing of chemical components as the bolt is rotated to set the expansion anchor.

A further object is to provide a novel and improved method of supporting and stabilizing a rock formation by enhancing the mixing of two, initially flowable components of a grouting mix within a drill hole in the course of setting a mechanical expansion anchor.

Still another object is to provide a combined resin-mechanical roof bolt anchor having novel and improved means for mixing the resin grouting components in the area of the drill hole below the expansion shell and plug.

Other objects will in part be obvious and will in part appear hereinafter.

SUMMARY OF THE INVENTION

The anchoring system of the invention includes a radially expansible shell and a tapered camming plug having a central, threaded bore for engagement with threads on the distal end of an elongated roof bolt carrying a bearing plate on its proximal end. The shell and plug may be of conventional design, as is a two-compartment, elongated cartridge containing initially flowable components of a resin grouting mix. The cartridge is inserted in a preformed drill hole, followed by the distal end of the bolt carrying the shell and plug of the mechanical expansion anchor. The cartridge is compressed against the blind end of the drill hole and fractured to release its contents by advance of the bolt to bring the bearing plate into contact with the rock formation surface surrounding the drill hole entrance. The expansion anchor is then set and the bolt tensioned by rotating the bolt with a power wrench, all in accordance with conventional practice.

The present invention is characterized by the provision of elongated leg means, fixed with respect to the expansion shell and extending downwardly from the lower end thereof for a distance at least about as great as the axial length of the shell. The volume of grouting mix contained in the cartridge is sufficient to substantially fill the drill hole from the blind end, about the expansion shell, plug and bolt, to a position significantly below the lower end of the shell. Preferably, the resin mix fills the drill hole around the bolt to a position at least as low as the terminal end(s) of the leg means.

It will be understood that terms such as upper, lower, above, below, etc., are used herein for convenience in connection with a drill hole, and elements positioned with respect thereto, which extends from an open end substantially vertically upwardly into the rock structure. Such may not be the case, of course, in all installations, but those skilled in the art will readily understand the principles of the invention from the terminology used.

The expansion anchor may be of the type wherein the shell and plug are maintained in assembled relation prior to expansion, with the smaller diameter end of the tapered plug extending into the upper end of the shell, by means of either or both of a bail and a support nut. Conventional bails include those having a medial portion in covering, closely adjacent relation to the larger diameter end of the camming plug with two, or sometimes more, leg members extending integrally from the medial portion and engaged with the shell. The leg means of the present invention may conveniently be formed as extensions of the bail legs when the expansion anchor is of the bail type.

In expansion anchors of the support nut type, the leg means may be spot welded or otherwise affixed to the shell at one or more convenient points thereon. The use of a support nut or jam nut threaded on the bolt in rather tight contact with the lower end of the shell may be advantageous even when a bail-type expansion anchor is used, as explained more fully later. The leg means may be formed of essentially flat sheet metal with parallel longitudinal edges, but preferably are of other configurations several of which are shown and described. Also, rigidity of the leg means may be increased by connecting two or more leg members to one another at a position adjacent their terminal ends.

Some degree of mixing of the grouting components takes place as the cartridge is forcefully ruptured against the blind end of the drill hole and the distal end of the bolt and expansion anchor are pushed upwardly through the components, as in similar prior art installations. Rotation of the bolt to set the expansion anchor produces turbulence due to frictional forces exerted by the bolt on the surrounding, viscous components. As the components tend to move about the drill hole they must flow around the leg means, thereby creating more turbulence and aiding in mixing of the components by the presence of the leg means.

These and other features of construction and operation of the anchoring means and method of the invention will be more readily understood and fully appreciated from the following detailed description, taken in conjunction with the accompanying drawings.

DETAILED DESCRIPTION

Figure 1:
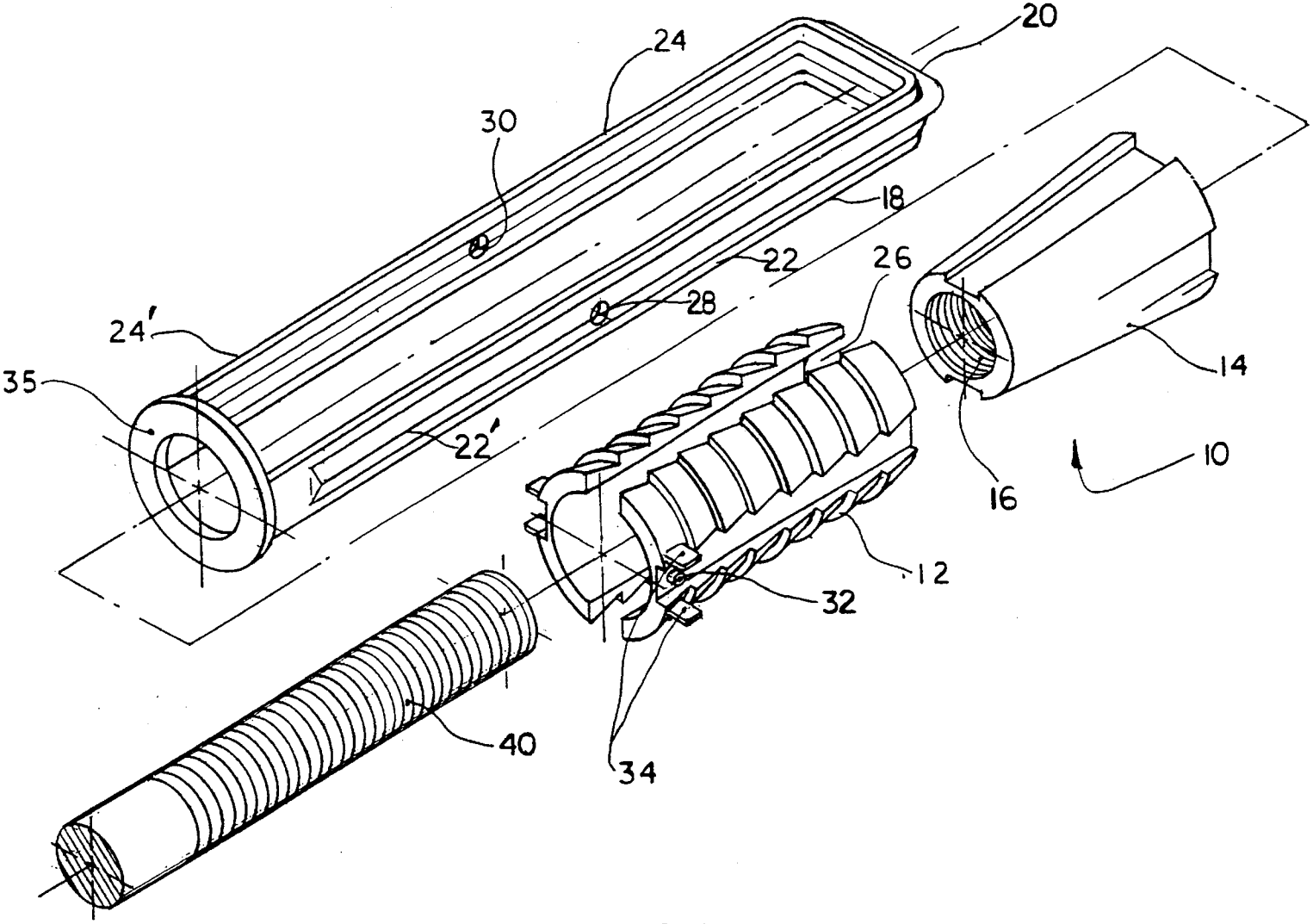
FIG. 1 is an exploded perspective view of an exemplary construction of a mine roof expansion anchor embodying aspects of the present invention.

Referring now to the drawings, in FIG. 1 is shown a mine roof expansion anchor, denoted generally by reference numeral 10, including shell portion 12, tapered nut or camming plug 14 having internally threaded, through bore 16 and bail 18 comprising medial portion 20 with elongated legs 22 and 24 extending integrally therefrom. Shell portion 12 includes a plurality of leaves 26 which are expanded radially outwardly by axial movement of camming plug 14 into the space surrounded by the leaves in well-known manner. Shell 12 and plug. 14 may be, and preferably are of entirely conventional construction, a wide variety of prior art designs being suitable for incorporation in the present invention. Both shell 12 and plug 14 are preferably malleable iron castings and bail 18 a metal stamping of corrosion resistant steel.

As in prior art expansion anchor assemblies, anchor 10 is assembled by inserting the smaller end of plug 14 in what is termed the upper end of shell 12 and placing medial portion 20 of bail 18 over the larger end of plug 14. Portions of bail legs 22 and 24 are then attached to shell 12, whereby shell 12 and plug 14 are maintained in assembled relation by bail 18. In the illustrated embodiment, openings 28 and 30 are formed in bail legs 22 and 24, respectively, and the bail is affixed to shell 12 in the conventional manner of short posts or bosses on the shell extending through openings 28 and 30, and a pair of tabs or ears on the shell being bent over the retained portions of the bail legs. One such post 32 and pair of ears 34 are seen on shell 12 in FIG. 1, it being understood that a like post and pair of ears are provided on the opposite side of the shell. Other conventional means may be used to secure the bail to the shell.

In the expansion anchor assembly of the present invention, bail legs 22 and 24 extend past the lower end of shell 12, i.e., the end opposite that in which plug 14 is inserted, by a distance at least about as great as the height of shell 12. That is, portions 22' and 24' of legs 22 and 24, respectively, which extend past (below) the lower end of shell 12 are at least as long as the shell's axial height, indicated in FIG. 1 by dimension h. Typical prior art bails terminate essentially at or near the position at which they are engaged with the shell or, as in the bail of U.S. Pat. No. 5,219,248 of the present inventor, extend a relatively short distance downwardly and outwardly from the lower end of the shell to provide enhanced frictional engagement of the expansion shell with the drill hole wall. Rigidity of legs 22 and 24 may be enhanced, if desired, by spot welding the terminal ends thereof to reinforcing ring 35.

Operation of the anchoring system will now be explained with reference to FIGS. 2–4. Reference numeral 36 denotes a cross section of a mine roof or other rock formation, having drill hole 38 of predetermined depth formed therein by conventional underground drilling equipment and procedures. Elongated rod 40, such as a section of rebar threaded at one end for a portion of its length, or a conventional mine roof bolt, is inserted through shell 12 and threaded into bore 16 of plug 14 until the end of the rod abuts medial portion 20 of bail 18. In the illustrated embodiment, nut 42 is threaded onto rod 40 prior to threaded engagement of the rod with plug 14 for purposes described hereinafter. Rod 40 also extends through openings in ring 35 and in conventional bearing plate 44 (FIG. 4) which is retained by washer 45 and headed portion 46 of the rod, or by a nut installed on the lower portion of the rod in cases where the lower end is threaded.

A conventional cartridge 48 of resin grouting, available from a number of manufacturers, is inserted into drill hole 38, followed by anchor 10 supported on the end of rod 40. Cartridge 48 includes an outer casing of flexible plastic containing two components which are initially separated by an inner casing and combine to form a mixture which quickly hardens upon breaking of the casings and mixing of the components. Rod 40 is inserted into drill hole 38 by means of conventional roof bolt installation equipment (not shown) which engages headed portion 46 and is adapted to advance the rod, and thereby anchor 10 and cartridge 48, axially as well as to effect rotation thereof.

Figure 2:
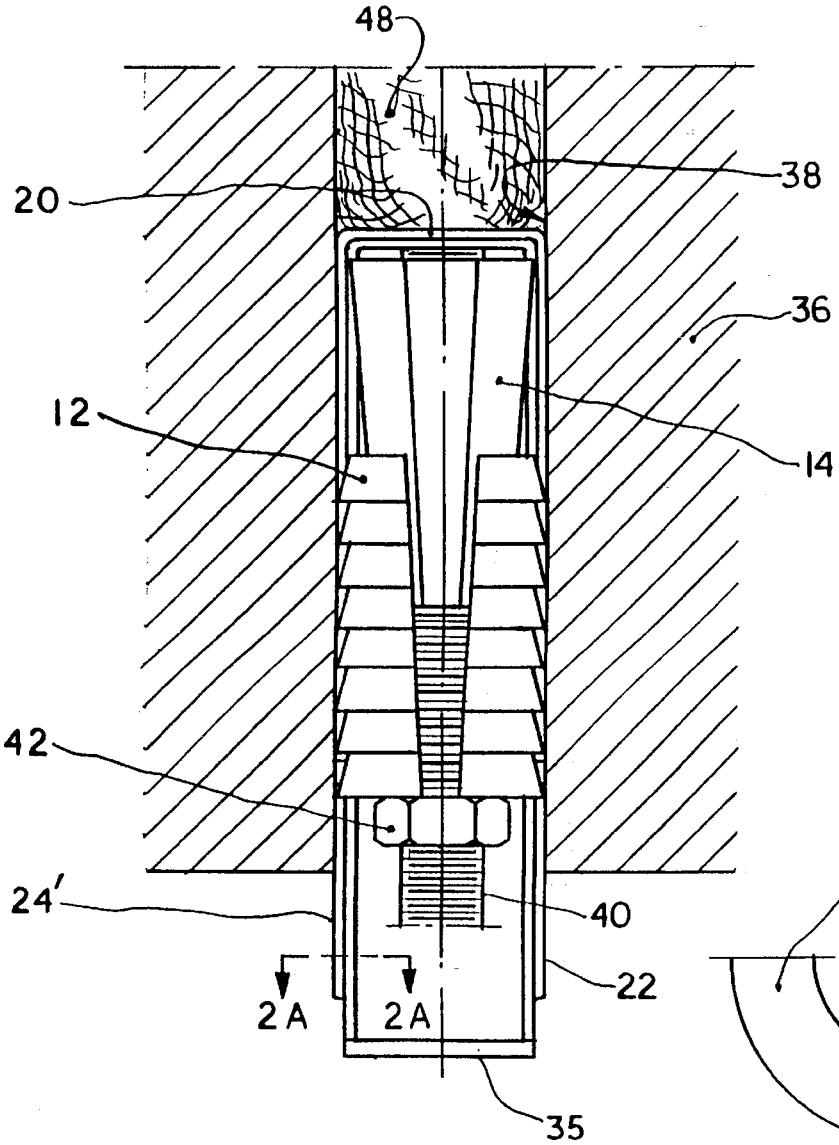
FIG. 2 is a vertical section of rock structure taken through a drill hole therein, with the expansion anchor of FIG. 1 shown in front elevation in conjunction with other elements of the anchoring system in a preliminary stage of installation.
Figure 3:
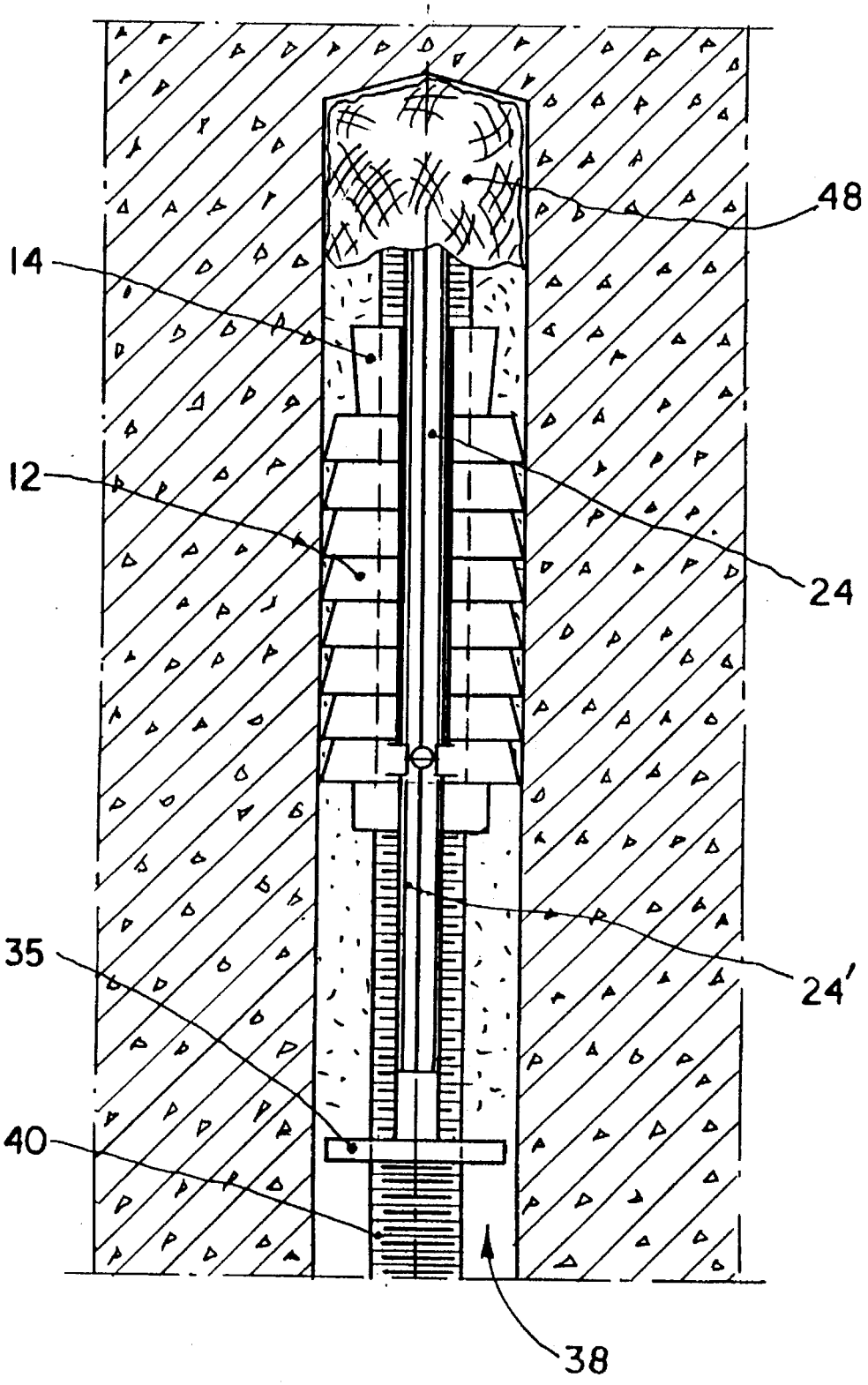
FIGS. 3 and 4 are sectional, elevational views, as in FIG. 2, with the anchor in side elevation, i.e., rotated 90° from the FIG. 2 position, showing intermediate and final stages of installation of the anchoring system.
Figure 4:
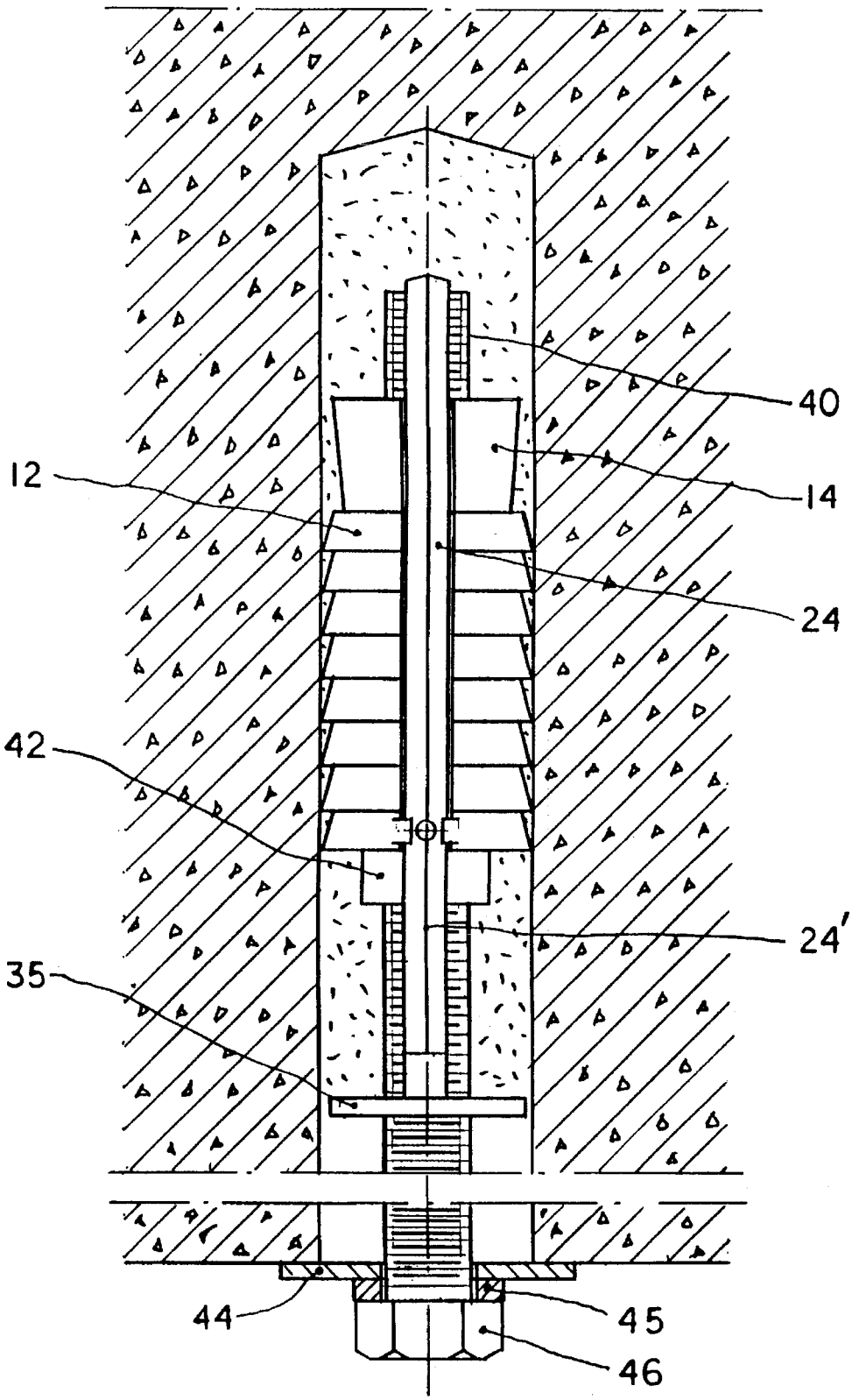

Rod 40 is advanced from the position of FIG. 2 to that of FIG. 3, thereby breaking the plastic casings of cartridge 48 against the blind end of drill hole 38 and causing the viscous components to flow around and through anchor 10, essentially filling the annular space between rod 40 and the wall of drill hole 38. The volume of chemicals in cartridge 48 is sufficient to substantially fill the annular space from the end of drill hole 38 preferably to about the position of the terminal ends of legs 22 and 24. Ring 35 may have a central opening closely surrounding rod 40, thereby limiting downward flow of the components, although the relatively high viscosities and quick setting times of modern resin mix components make such flow-limiting means essentially unnecessary. As soon as the elements have been advanced to a position, wherein bearing plate 44 engages the surface of rock formation 36, rod 40 is rotated to cause plug 14 to travel axially down the bolt threads and expand leaves 26 outwardly into tight frictional engagement with the walls of drill hole 38, as shown in FIG. 4.

Figure 2A:
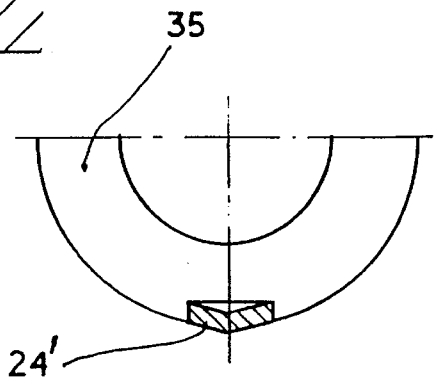
FIG. 2A is an enlarged, top plan view in section on the line 2A—2A of FIG. 2.
Figure 5:
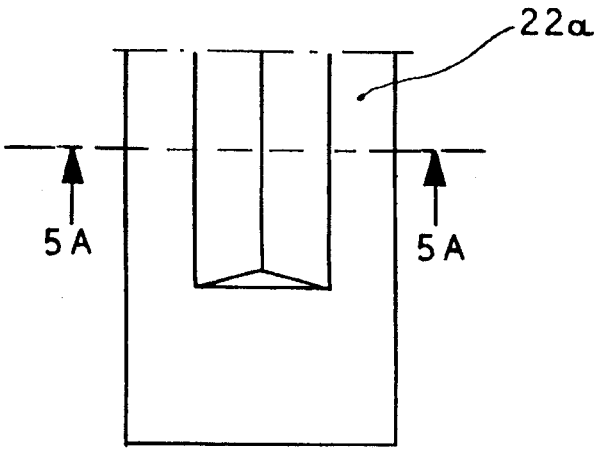
FIG. 5 is a fragmentary, elevational view of a second configuration of one of the elements of the expansion anchor of FIG. 1–4.
Figure 6B:
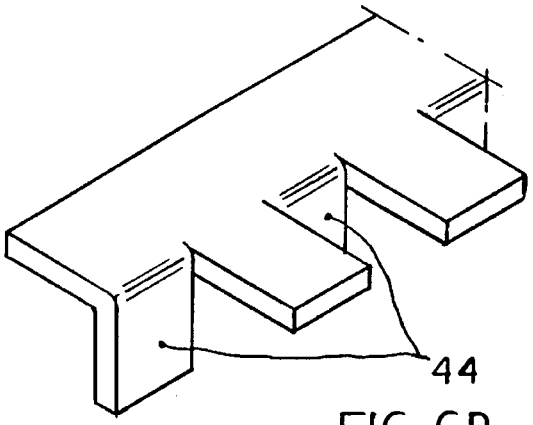
FIG. 6B is a perspective view of the fragment of FIG. 6.
Figure 6:
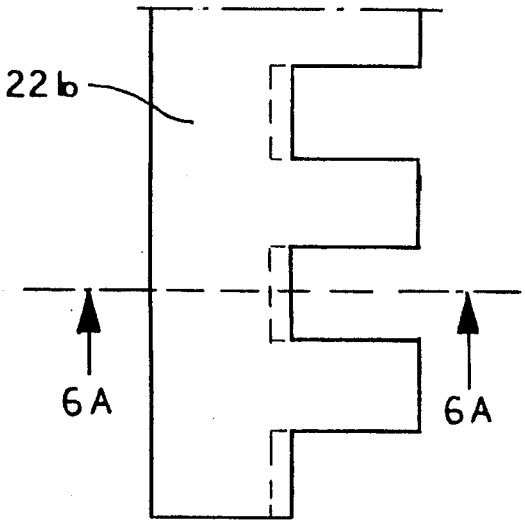
FIG. 6 is a fragmentary, elevational view of a third configuration of the element of FIG. 5.
Figure 6A:
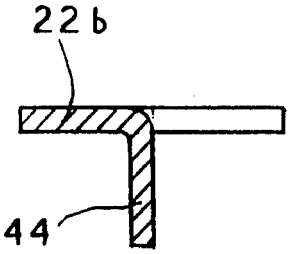
FIG. 6A is a top plan view in section on the line 6A—6A of FIG. 6.

Although the portions of legs 22 and 24 which extend from medial portion 20 to the lower end of shell 12 may be flat, as in conventional bail constructions, portions 22' and 24' are preferably of other configuration in cross section transverse to their longitudinal axes. In FIG. 2A, portion 24' is seen to have a V-shaped cross section, which is also the cross section of portion 22', with flat portions adjacent the terminal ends. Alternate configurations are shown in FIGS. 5 and 6, that of FIG. 5, denoted by numeral **22*a*, being V-shaped at a laterally intermediate position and flat in the areas adjacent each side edge and the terminal end. The flat portions facilitate the spot welding thereto of reinforcing ring 35. Leg 22*b* of the FIG. 6 configuration is an initially flat strip with a succession of evenly spaced cuts extending about half the width of the strip. Portions between alternate cuts are bent to form a succession of spaced tabs 49 extending at 90° to the major surface of the strip, as seen in FIGS. 6A and 6**B, thus being positioned substantially radially of the drill hole.

Figure 5A:
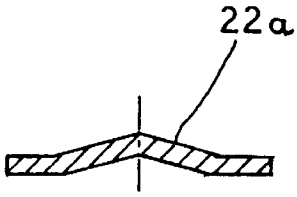
FIG. 5A is a top plan view in section on the line 5A—5A of FIG. 5.
Figure 7:
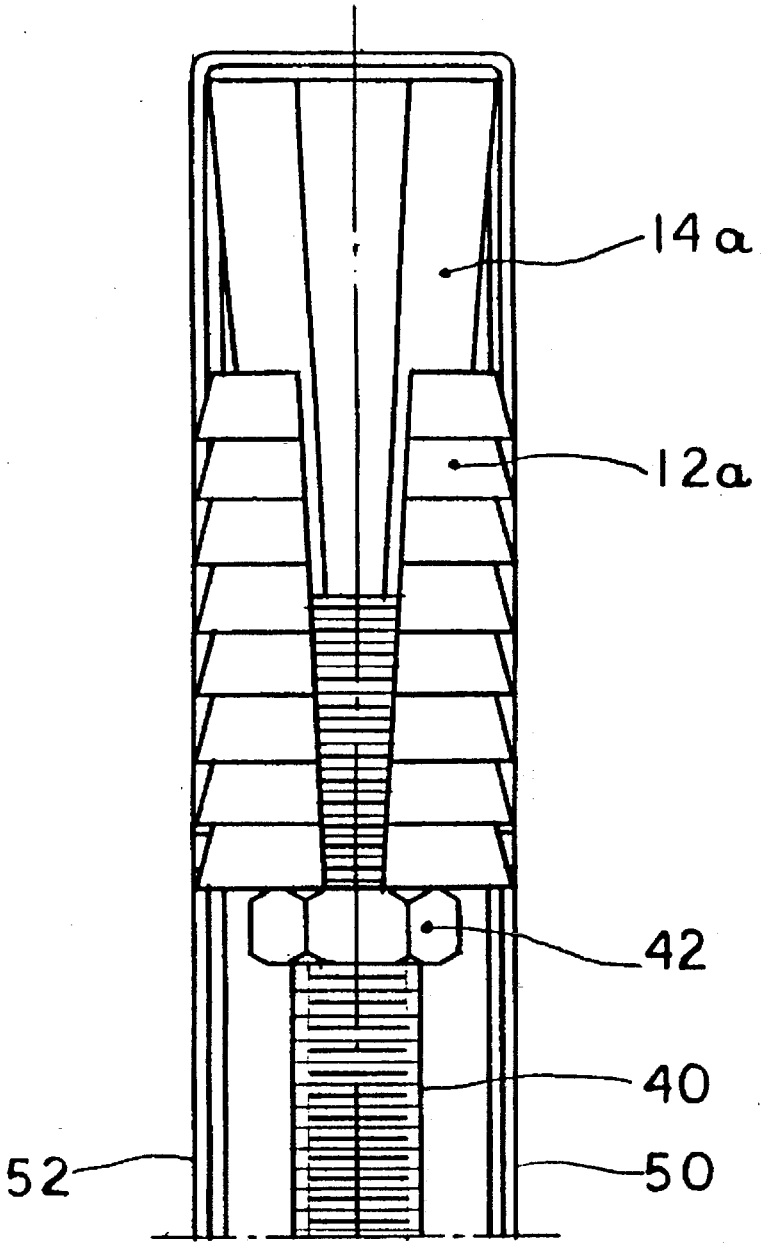
FIG. 7 is an elevational view of a further embodiment of the anchor, shown mounted on a bolt with a support nut.

In the FIG. 7 embodiment, shell **12*a* is supported on rod 40 by support nut 42 with the smaller end of plug 14*a* extending into the upper end of shell. Although no bail is employed, leg means 50 and 52 are spot welded to shell 12*a* near its lower end to extend downwardly for a distance at least about as great as the height of shell 12*a*. The cross sectional configuration of leg means 50 and 52 may be essentially flat, as shown, but preferably conforms to one of the configurations shown in FIGS. 2A, 5A and 6**A or other shapes providing surfaces of the leg means extending other than substantially concentrically with respect to the central axis of the anchor in order to produce more hydraulic turbulence in the resin components.

The use of a support nut or jam nut on the threaded rod, with the shell rather tightly engaged between this nut and the camming plug, may cause the entire anchor to turn a few revolutions together with the rod before the plug moves axially down the rod to expand the shell. This action will create additional turbulence as the leg means rotate through the grouting mix components, thereby further enhancing mixing in the area below the expansion anchor. While the presence of a single leg member extending downwardly from the lower end of the shell will enhance mixing to some degree, it is preferred that the leg means comprise two or more elongated members.

What is claimed is:

1. A mine roof expansion anchor for anchoring the threaded, distal end of an elongated rod securely in a drill hole in a rock formation, said assembly comprising, in combination:

a) a hollow shell structure having a plurality of leaf members, each having an upper and a lower end and an inner and an outer surface, said leaf members being arranged relative to one another with said inner surfaces radially spaced from a central axis and said upper and lower ends in respective, substantially common, parallel, upper and lower planes;

b) a tapered camming plug having relatively large and small ends and a threaded, through bore for engagement with said threaded end of said rod, said plug being arranged with said small end extending into the space surrounded by said leaf upper ends and said bore substantially coaxial with said central axis, axial movement of said plug toward said lower ends of said leaves in response to rotation of said rod acting to radially expand said leaves into tightly gripping engagement with the wall of said drill hole; and c) elongated leg means fixed with respect to said shell and extending downwardly from said lower plane for a distance at least about as great as the distance between said upper and lower planes.

2. The anchor assembly of claim 1 and further including bail means having a medial portion extending over said large end of said plug and a connecting portion extending from said medial portion and engaged with said shell to maintain said plug and shell in assembled relation prior to said radial expansion of said shell.

3. The anchor assembly of claim 2 wherein said leg means extend integrally from said connecting portion.

4. The anchor assembly of claim 3 wherein said connecting portion is fixedly attached to said shell.

5. The anchor assembly of claim 4 wherein said connecting portion comprises a pair of elongated members extending integrally from said medial portion along opposite sides of said shell, substantially parallel to said central axis, each of said elongated members being fixedly attached to said shell at positions adjacent said lower ends of said leaves.

6. The anchor assembly of claim 5 wherein said leg means comprise integral extensions of each of said elongated members.

7. The anchor assembly of claim 2 wherein said bail means is formed from a unitary blank of sheet metal.

8. The anchor assembly of claim 7 wherein said leg means comprise at least two members spaced from one another about the periphery of said lower end of said shell structure and extending substantially parallel to said central axis.

9. The anchor assembly of claim 8 and further including means rigidly connecting said members to one another at positions spaced from said lower end of said shell structure.

10. The anchor assembly of claim 8 wherein at least portions of each of said members comprise surfaces extending other than substantially concentrically with respect to said central axis.

11. The anchor assembly of claim 10 wherein said portions of said members are substantially V-shaped in a cross sectional plane normal to said central axis.

12. The anchor assembly of claim 10 wherein said portions comprise a plurality of spaced tabs extending integrally from respective, base portions of said members transversely to said central axis.

13. The anchor assembly of claim 10 wherein said members extend from said lower end of said shell structure to terminal ends in a substantially common plane parallel to said upper and lower planes, and further including means rigidly connecting said members to one another at positions closer to said terminal ends than to said shell structure.

14. The anchor assembly of claim 13 wherein said connecting means comprises a ring-like element.

15. The anchor assembly of claim 14 wherein said ring-like element is welded to each of said members.

16. A system for supporting and reinforcing a rock structure having a surface and a blind drill hole of predetermined length and diameter extending into said rock structure from an open end in said surface, said means comprising:

a) an elongated rod threaded from a distal end for a portion of its length toward a proximal end;

b) a mechanical expansion anchor including a tapered nut threadedly engaged with said distal end and a hollow shell radially expansible by axial movement of said nut on said rod in response to rotation of said rod with respect to said anchor;

c) a bearing plate carried by said proximal end for engagement with said surface upon tensioning of said rod with said distal end thereof anchored in said hole;

d) a two-compartment cartridge containing respective components of a grouting material, said components being in a flowable state while separate and hardenable to a solid mass when released from said cartridge and mixed within said drill hole; and e) elongated leg means fixed with respect to said expansion anchor and extending toward said distal end from the portion of said anchor nearest said distal end for a distance at least about as great as the axial length of said shell, whereby said leg means present an impediment to free flow of said components about said drill hole in response to rotation of said rod and thereby assist in the mixing of said components.

17. The system of claim 16 wherein said expansion anchor further includes bail structure engaged with said shell for maintaining said shell and nut in mutually assembled relation prior to installation.

18. The system of claim 17 wherein said leg means extend integrally from said bail structure.

19. The system of claim 16 and further comprising a nut threaded on said rod below said expansion anchor, said shell having a lower surface in physical contact with said nut.

20. The system of claim 19 and further including a sheet metal bail having a pair of members fixedly attached to said shell on opposite sides thereof.

21. The system of claim 20 wherein said leg means are integral extensions of said pair of members.

22. The method of installing a reinforcing and support system for a rock structure having a surface and a blind drill hole of first length and diameter extending into said rock structure from an open end in said surface, said method comprising:

a) forming external threads on an elongated rod of second length and diameter, said threads extending from a distal end toward a proximal end of said rod;

b) mounting upon said distal end a mechanical expansion anchor including a tapered nut and radially expansible, hollow shell by engagement of internal threads of said nut with said external threads, said shell having a predetermined axial length;

c) providing elongated leg means fixed with respect to said shell to extend from the portion of said shell nearest said distal end toward said distal end for a distance at least about as great as said axial length;

d) inserting into said drill hole a two-compartment cartridge containing respective components of a grouting material, said components being in a flowable state while separate and hardenable to a solid mass of predetermined volume when released from said cartridge and mixed within said drill hole;

e) inserting said distal end of said rod with said expansion anchor and leg means thereon into said drill hole and advancing said rod to a fully inserted position, said first and second lengths being so related that said cartridge is broken against the blind end of said drill hole when said rod is in said fully inserted position with said proximal end remaining outside said drill hole, and said second diameter being smaller than said first diameter to provide an annular space within said drill hole surrounding said rod, said predetermined volume substantially filling said drill hole from said blind end, through said hollow shell and said annular space to cover substantially all of said leg means; and f) rotating said rod to move said nut axially thereon to effect expansion of said shell into tightly gripping engagement with said drill hole and tensioning of said rod, whereby hydraulic turbulence of said components within said annular space is induced by rotation of said rod and mixing of said components is enhanced by flow of said components about said leg means.

23. The method of claim 22 and further comprising the step of mounting upon said distal end a support nut prior to mounting said expansion anchor on said distal end, said shell having a lower surface in physical contact with said nut upon mounting of said anchor upon said distal end.

24. The method of claim 22 and further comprising the step of securing to said proximal end a bearing plate which is urged into engagement with said rock structure surface upon tensioning of said rod.

25. The method of claim 24 and further comprising the step of securing to said shell a bail structure for maintaining said tapered nut and shell in mutually assembled relation, said bail structure including at least one elongated engagement portion extending along one side of said shell.

26. The method of claim 25 and further including forming said leg means as an integral extension of said engagement portion.

27. The method of claim 25 wherein said bail structure includes a pair of said elongated engagement portions extending along opposite sides of said shell, and further comprising forming said leg means as integral extensions of each of said engagement portions.

28. The method of claim 27 and further comprising forming said leg means to have surface portions extending transversely of a path extending concentrically around the axis of said drill hole.

29. The method of claim 28 and further comprising forming said surface portions to extend substantially radially of said drill hole.

30. The method of claim 27 and further including the step of fixedly attaching said leg means to one another.

* * * * *